US006076463A

United States Patent [19]

Vrotacoe et al.

[11] Patent Number: 6,076,463

[45] Date of Patent: Jun. 20, 2000

[54] INK METERING DEVICE AND METHOD OF METERING INK

[75] Inventors: James Brian Vrotacoe, Rochester, N.H.; Edward Ellis Urquhart, Northboro, Mass.

[73] Assignee: Heidelberger Druckmaschinen AG, Heidelberg, Germany

[21] Appl. No.: 09/140,928

[22] Filed: Aug. 27, 1998

Related U.S. Application Data

[63] Continuation-in-part of application No. 09/039,011, Mar. 13, 1998, abandoned.

[51] Int. Cl.[7] ..... B41F 31/04; B41F 31/08

[52] U.S. Cl. ..... 101/363; 101/366; 101/350.1

[58] Field of Search ..... 101/350.1, 350.6, 101/363, 364, 366, 169, 167, 155, 157

[56] References Cited

U.S. PATENT DOCUMENTS

| | | | |
|---|---|---|---|
| 2,177,656 | 10/1939 | Kaddeland | 101/157 |
| 3,439,609 | 4/1969 | Dorr | 101/366 |
| 3,899,999 | 8/1975 | Christ et al. | 101/366 |
| 3,922,966 | 12/1975 | Despot | 101/350.1 |
| 4,050,380 | 9/1977 | Pfizenmaier | 101/365 |
| 4,058,058 | 11/1977 | Hantscho | 101/364 |
| 4,085,672 | 4/1978 | Grosart | 101/169 |
| 5,072,669 | 12/1991 | Weisbrod et al. | 101/363 |
| 5,297,490 | 3/1994 | Schneider et al. | 101/167 |
| 5,477,782 | 12/1995 | Nguyen | 101/157 |
| 5,957,051 | 9/1999 | Atwater | 101/366 |

FOREIGN PATENT DOCUMENTS

| | | |
|---|---|---|
| 025 886 | 4/1981 | European Pat. Off. . |
| 0 813 962 | 12/1997 | European Pat. Off. . |
| 788 082 | 10/1935 | France . |

*Primary Examiner*—Stephen R. Funk
*Assistant Examiner*—Leslie J. Grohusky
*Attorney, Agent, or Firm*—Kenyon & Kenyon

[57] ABSTRACT

An ink metering device and method. Ink is fed at a pressure to an orifice. Pressure may be achieved by either an ink pump or a gravity feed. The size of the orifice may be varied according the conditions existing in the printing press. The pressure at which the ink is fed may also be varied. Ink exiting the orifice is fed onto the surface of an ink applicator roll. At a location downstream of the orifice, a control blade is positioned adjacent the outer surface of the ink applicator roll. The distance between the tip of the control blade and the outer surface of the ink applicator roll may be varied using a control blade positioning mechanism. The distance between the tip of the control blade and the outer surface of the ink applicator roll controls the smoothness and/or the thickness of an ink film which is created on the surface of the ink applicator roll. This film is transferred directly to the image or plate cylinder, which is in contact with the outer surface of the ink applicator roll. The area between the control blade, the outer surface of the ink applicator roll and the orifice creates a cavity which includes a meniscus of ink directly behind the control blade. The action of the control blade and the meniscus will ensure that the film of ink on the ink applicator roll is smooth, and therefore that the ink applied to the image or plate cylinder is also smooth.

8 Claims, 1 Drawing Sheet

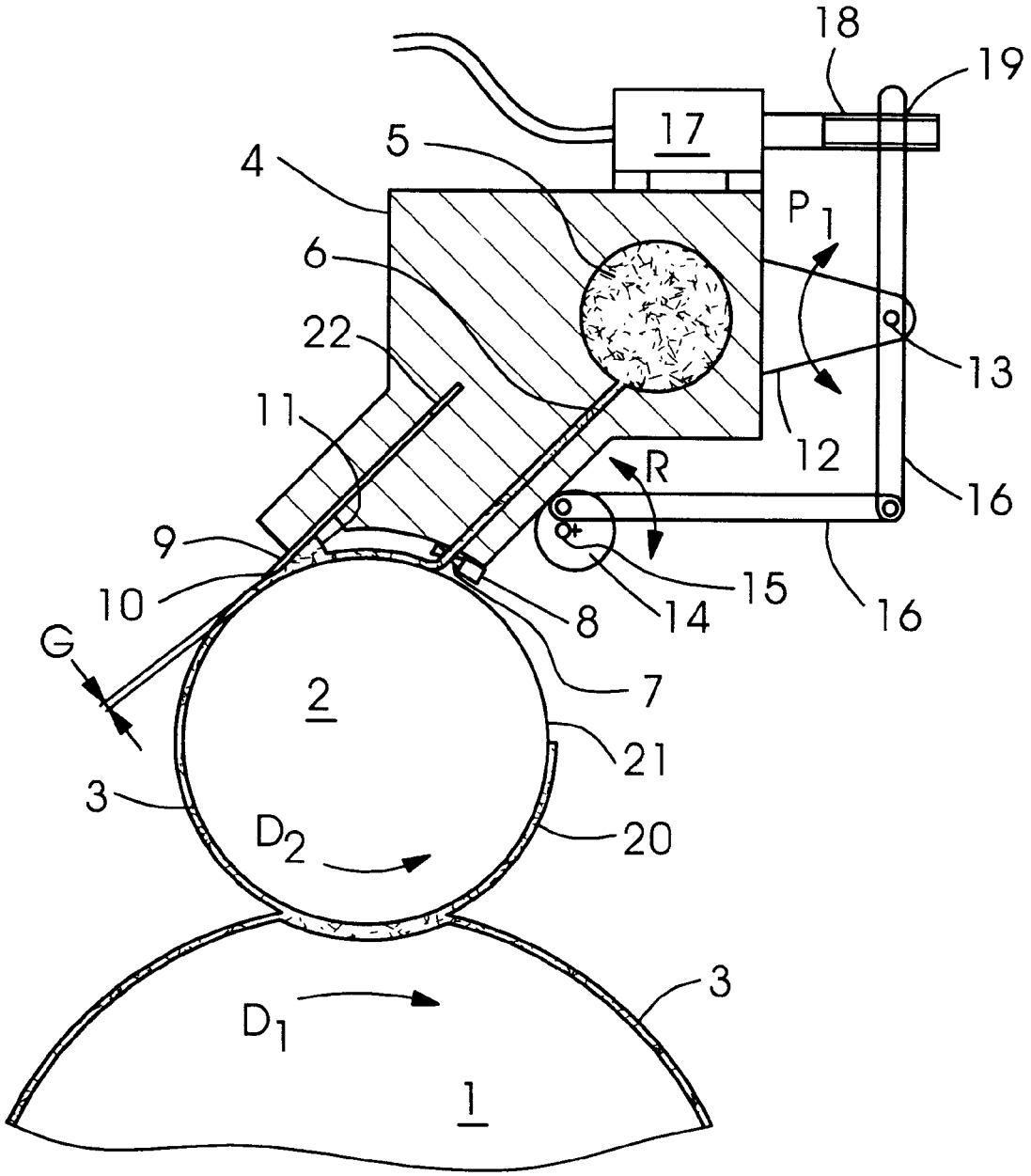
18
19
17
5
4
P1
6
22
13
11
12
R
16
9
15
10
14
16
8
G
7
2
21
3
D2
20
3
D1
1

INK METERING DEVICE AND METHOD OF METERING INK

This application is a continuation-in-part of U.S. patent application Ser. No. 09/039,011, filed Mar. 13, 1998 now abandoned.

BACKGROUND OF THE INVENTION

1. Field of the Invention

The present invention relates to a method and device for metering ink in an offset printing press.

2. Description of the Prior Art

Offset printing presses are well known in the printing art. In an offset printing press, an image or plate cylinder which contains on its outer surface an image to be printed rotates in contact with either the paper upon which the image is to be printed, or preferably, rotates in contact with a transfer or blanket cylinder which transfers the image from the image cylinder to the paper. Ink is transferred to the image cylinder, which ink is thereafter transferred either directly to the paper or to the transfer cylinder and then to the paper.

There are several known ways in which ink may be fed to an image cylinder in an offset printing press. The most common way of feeding ink to an image cylinder is the use of an ink fountain. An ink fountain is a device in which a fountain roll has mounted against it a trough which is filled with ink. At the interface between the bottom of the trough (i.e., the ink fountain) and the fountain roll are located a series of ink keys. The ink keys may be moved toward and away from the fountain roll, and the distance between the end of each ink key and the surface of the fountain roll determines the thickness of ink applied by the ink key on the outer surface of the fountain roll. The fountain roll is in close proximity with, in an area past the ink keys in the direction of rotation of the fountain roll, a metering roll.

Metering rolls used with prior art ink fountains normally contain a spiral or "barber pole" groove on the outer surface. This spiral groove assists in removing contaminants from the metering roll. The contaminants flow into the spiral groove, and are removed from the end of the metering roll by the spiral shape of the groove in conjunction with the rotation of the metering roll. Because the contaminants are contained in the spiral groove, they are not transferred to any downstream rolls, and therefore the image cylinder is not contaminated. However, the use of a spiral groove on the metering roll causes a flute pattern of differing ink thicknesses on the metering roll. The flute pattern must be smoothed out from any ink film before it is transferred to the image cylinder. In order to smooth out the flute pattern from a metering roll, prior art devices have used an ink train containing a large number of smoothing rollers (commonly eleven to fifteen) between the metering roll and the image cylinder. The ink is transferred, sequentially, from the metering roll to each of the smoothing rollers before it is transferred to the image cylinder. Each sequential step of ink transfer from one smoothing roller to another incrementally smooths out the flute pattern in the ink from the metering roll. As will be readily understood, the need for a large number of smoothing rollers complicates the printing press apparatus and increases costs.

Another problem with the use of ink fountains is weeping. Weeping is caused by drops which accumulate at the ink key/fountain roll interface. These drops can drip onto portions of the printing press, including the ink train, thereby altering the printed image or the condition of the ink fed to the image roll. Additionally, heat can build up as the result of contact between the rigid ink keys and the fountain roll. This heat build-up can alter conditions of the ink or the rollers, thereby affecting print quality. Finally, two other problems which occur with the use of prior art ink metering systems are "ghosting" and "starvation." Ghosting and starvation are caused by the excess ink on the image or plate cylinder which does not get transferred to the paper in areas where there is no image to be printed. This excess ink, or conversely, the lack of ink resulting from the removal of ink for printing the image, can cause variations in the ink film depth size on the image cylinder in subsequent printings. Such variations in ink film depth size can alter the quality of the image printed.

A second device for distributing ink to an image cylinder is a ductor. A ductor is a roll which is not kept in constant contact with the fountain roll. Instead the ductor oscillates between the fountain roll and the image cylinder. When the ductor contacts the fountain roll, it rotates at the speed of the fountain roll; when the ductor contacts the image cylinder it rotates at the speed of the press. As will be readily understood, the mechanism used to drive the ductor is necessarily complicated and expensive.

SUMMARY OF THE INVENTION

The present invention is an ink metering device and method which eliminates the problems of prior art devices used to meter ink to an image cylinder. In the device of the present invention, ink is fed at pressure to an orifice. Ink pressure may be achieved by either an ink pump or a gravity feed. The size of the orifice may be varied according the conditions existing in the printing press, such as properties of the ink being used, temperature, etc. The pressure at which the ink is fed may also be varied according to the conditions existing in the printing press.

Ink exiting the orifice is fed onto the surface of an ink applicator roll. At a location downstream of the orifice, a control blade is positioned adjacent the outer surface of the ink applicator roll. The distance between the tip of the control blade and the outer surface of the ink applicator roll may be varied. The distance between the tip of the control blade and the outer surface of the ink applicator roll, and/or the volume of ink which is delivered through the orifice to the ink applicator roll (which is controlled by the size of the orifice and/or the ink pressure upstream of the orifice), controls the thickness of an ink film which is created on the surface of the ink applicator roll. The control blade also smooths the ink film. This film is transferred directly to the image or plate cylinder, which is closely adjacent to the outer surface of the ink applicator roll. The control blade is preferably flexible, and may be designed so that its flexibility can be varied. The control blade may be sufficiently flexible so that it only smooths, and does not meter, the ink on the ink applicator roll, and therefore only the size of the orifice and/or the pressure of the ink controls the thickness of the ink film.

The area between the control blade, the outer surface of the ink applicator roll and the orifice creates a cavity which includes a meniscus of ink directly behind the control blade. The size of this meniscus, the size of the gap between the control blade and the outer surface of the ink applicator roll, the size of the orifice, the pressure of ink upstream of the orifice, and/or the speed of the ink applicator roll, will all act to control the flow of ink into and out of the cavity. The speed of the ink applicator roll will be identical to the speed of the image or plate cylinder. The action of the control blade and the meniscus will ensure that the film of ink on the ink applicator roll is smooth, and therefore that the ink applied to the image or plate cylinder is also smooth. The presence of a meniscus behind the control blade of the ink metering device of the present invention prevents starvation (i.e., the lack of any ink being transferred) on the ink applicator roll, and the control blade prevents ghosting (i.e., excess ink being transferred) on the ink applicator roll. Thus, the ink film flowing to the ink applicator roll from the control blade will be smooth because of the combined action of the meniscus and the control blade.

The ink metering device of the present invention shears ink, using the control blade, to create an ink film, instead of splitting ink in tension, as is done with ink trains of the prior art. As a result, the ink film is smoothed as it is applied to the applicator roll, thereby eliminating the need for a long train of smoothing rollers. The control blade and meniscus of the present invention also eliminate the problem of ghosting or starvation by disrupting the residual ink film which is returned from the image cylinder, thereby preventing the residual ink from affecting a subsequently-created ink film.

BRIEF DESCRIPTION OF THE DRAWING

The foregoing and other features of the present invention will become apparent to those skilled in the art to which the present invention relates from reading the following description with reference to the accompanying drawing, in which the drawing FIGURE shows a schematic partially cross-sectional elevational view of one embodiment of the present invention.

DETAILED DESCRIPTION OF THE INVENTION

In a preferred embodiment of the present invention, an image or plate cylinder 1 transfers an inked image either directly to paper (either in the form of sheets or in the form of a web), or preferably transfers an inked image to a transfer or blanket cylinder (not shown), which in turn transfers the inked image to paper. The manner in which an image cylinder 1 transfers an inked image to paper is well known in the art and will not be further described. The image cylinder 1 rotates in direction $D_1$.

An ink applicator roll 2 rotates with image cylinder 1. Ink applicator roll 2 rotates in direction $D_2$. Ink applicator roll 2 transfers a film 3 of ink from ink applicator roll 2 to image cylinder 1.

Mounted above ink applicator roll 2 is an ink film applicator 4. Ink film applicator 4 is preferably rigidly mounted to a side frame (not shown) of the printing press. Ink film applicator 4 includes an ink source 5, which contains ink at pressure. Ink source 5 can be a bore or reservoir within ink film applicator 4, which is fed by, e.g., an ink pump or a gravity feed. It is to be understood that the pressure at which the ink is fed to ink source 5 can differ depending upon the particular application, such as the properties of the ink used, the temperature, etc. An ink channel 6 leads from ink source 5, and feeds ink to an orifice 7. Orifice 7 can be adjusted in size. A portion 8 of ink film applicator which defines the ink channel 6 has a degree of flexibility, and is in contact with a cam 14. This flexibility is created by cuts or thinned portions (not shown) between the portion 8 and the ink film applicator 4. In the embodiment of the drawing FIGURE, a mechanism is shown for flexing the portion 8, to thereby change the size of the orifice 7. Ink film applicator 4 has mounted on it a bracket 12, which bracket 12 includes at one end a pin or shaft 13. A cam 14 is in contact with the portion 8 of ink film applicator 4 which controls the size of the orifice, and cam 14 pivots about an eccentrically-mounted pin or shaft 15. A linkage 16 is connected to cam 14, and rotates cam 14 around eccentrically-mounted pin or shaft 15. A reversible rotary motor 17, which may include a lead screw 18 connected to linkage 16 by a threaded bore 19, controls the position of linkage 16 and cam 14. As a result, rotary motor 17 acts to flex portion 8 back and forth, thereby changing the size of orifice 7. Linkage 16 moves in a direction $P_1$, which moves cam in direction R, thereby flexing portion 8 towards or away from the ink film applicator 4 and decreasing or increasing the size of orifice 7.

Ink flows down ink channel 6 at pressure and then exits from orifice 7 onto the outer surface 21 of ink applicator roll 2. As will be readily understood by those skilled in the art, the pressure of the ink in ink source 5 and the size of orifice 7 will control the rate at which ink is applied to the surface of ink applicator roll 2.

Located downstream, i.e., along the direction of rotation of ink applicator roll 2, of orifice 7 is a control blade 9, which may be flexible and is preferably mounted on ink film applicator 4. A tip 10 of control blade 9 is spaced by a gap G from the outer surface of ink applicator roll 2. The size of the gap G can control the thickness of the ink film 3 on the ink applicator roll 2 which is transferred to the image cylinder 1, if the control blade 9 is of sufficient stiffness. Ink which does not pass between the tip 10 of the control blade 9 and the outer surface of the ink applicator roll 2 to form ink film 3 forms a meniscus 11 behind control blade 9.

The size of the gap G, and therefore the thickness of the ink film 3, may be varied by changing the position of the control blade 9. Control blade 9 may be adjustable within a slot 22, to thereby allow adjustment of the position of the control blade 9 relative to the ink applicator roll 2. A set screw (not shown) may be used to fix the control blade 9 in place after adjustment of its position. The stiffness of flexible control blade 9 can also be varied by changing its position within the slot 22. The flexible control blade 9 can alternatively be made to be of sufficient flexibility that it only smooths (i.e., does not scrape) the ink film 3, and does not control the metering of ink (i.e., the thickness of the ink film) onto ink applicator roll 2. In that circumstance, ink is metered only by the size of the orifice 7 and the pressure of ink in ink source 5.

The method of the present invention is as follows. Ink is fed at pressure, from, e.g., an ink pump or gravity feed (not shown), into ink source 5. Ink travels down ink channel 6 and out orifice 7. Prior to feeding ink to ink source 5, the size of orifice 7 may be adjusted using motor 17, linkage 16, cam 14 and portion 8, and the pressure at which ink is fed into ink source can be controlled by adjusting the ink pump or gravity feed in any known way. Also prior to feeding ink to ink source 5, the position and/or stiffness of control blade 9 may be adjusted by adjusting its position in slot 22, and thereafter affixing flexible control blade 9 in slot 22 by known mechanisms, such as set screws (not shown). Ink flowing through orifice 7 is deposited on the outer surface of ink applicator roll 2, which ink applicator roll 2 travels in direction $D_2$. Ink deposited on the outer surface of ink applicator roll 2 by orifice 7 travels toward flexible control blade 9.

Ink traveling toward flexible control blade 9, either from orifice 7 or residual ink 20 transferred back from image cylinder 1, accumulates in meniscus 11 behind flexible control blade 9 and then consequently passes through gap G to create ink film 3 on ink applicator roll. Because of the existence of meniscus 11, and because of the gap G created by control blade 9, the ink film is always smooth and uniform, and ghosting—caused by residual ink 20 on ink applicator roll—or starvation—caused by un-inked areas on ink applicator roll 2—is prevented. The ink film 3 on ink applicator roll 2 is transferred directly to plate cylinder 1 as the result of the close proximity of those rolls to one another. The ink film 3 on image cylinder 1 is used to create a printed image for transfer to paper (not shown), either directly or via a transfer cylinder (not shown).

At any time during the method of the present invention, the thickness of the ink film 3 may be changed by changing the size of the gap G or the rate of ink flow out of orifice 7. To change the size of the orifice 7, to thereby change the rate of ink flow through orifice 7, reversible rotary motor 17 is energized, to turn lead screw 18 either clockwise or counterclockwise. Turning of lead screw 18, through interaction with threaded bore 19, causes pivoting of linkage 16 in direction $P_1$, which in turn rotates cam 14 in direction R. Rotation of cam 14 in direction R causes portion 8 to flex toward or away from ink film applicator 4, which in turn changes the size of orifice 7. As a result the rate of flow of ink to the ink applicator roll 2 is varied. This ink flow rate may also be varied by changing the ink pressure in ink source 5. The size of the gap G may be varied by adjusting the position of the control blade 9 in slot 22.

In the above description of the invention, those skilled in the art will perceive improvements, changes and modifications. Improvements, changes and modifications within the skill of the art are intended to be covered by the claims.

What is claimed is:

1. A fluid applicator comprising:

a fluid source, the fluid source containing fluid at a pressure;

an adjustable orifice, the fluid source being in communication with the orifice, fluid from the fluid source flowing through the orifice;

a rotating applicator roll, fluid flowing from the orifice flowing onto an outer surface of the applicator roll;

a control blade, the control blade being located downstream of the orifice, the control blade smoothing a fluid film on the outer surface of the applicator roll; and a cam, the cam adjusting the size of the orifice.

2. The fluid applicator of claim 1, further comprising:

a motor, the motor controlling the position of the cam.

3. The fluid applicator of claim 2, further comprising:

a linkage, the linkage connecting the motor and the cam.

4. An ink metering device comprising:

an ink source, the ink source containing ink at a pressure;

an adjustable orifice, the ink source being in communication with the orifice, ink from the ink source flowing through the orifice;

a rotating ink applicator roll, ink flowing from the orifice flowing onto an outer surface of the ink applicator roll;

a control blade, the control blade being located downstream of the orifice, the control blade smoothing an ink film on the outer surface of the ink applicator roll; and a cam, the cam adjusting the size of the orifice.

5. The ink metering device of claim 4, further comprising:

a motor, the motor controlling the position of the cam.

6. The ink metering device of claim 5, further comprising:

a linkage, the linkage connecting the motor and the cam.

7. A method of metering fluid comprising the steps of:

providing a source of fluid at a pressure;

passing the fluid from the source of fluid through an orifice;

applying fluid from the orifice onto an outer surface of a rotating applicator roll;

providing a control blade located downstream of the orifice;

controlling a thickness of a fluid film on the outer surface of the applicator roll; and adjusting the size of the orifice.

8. A method of metering ink comprising the steps of:

providing a source of ink at a pressure;

passing the ink from the source of ink through an orifice;

applying ink from the orifice onto an outer surface of a rotating ink applicator roll;

providing a control blade located downstream of the orifice;

controlling a thickness of an ink film on the outer surface of the ink applicator roll; and adjusting the size of the orifice.

* * * * *